United States Patent [19]

Magee

[11] Patent Number: 4,905,663

[45] Date of Patent: Mar. 6, 1990

[54] UNDERFIRED KETTLE

[76] Inventor: S. Jim Magee, 2223 Gale Avenue, Coquitlam, British Columbia, Canada, V3K 2Y9

[21] Appl. No.: 320,489

[22] Filed: Mar. 8, 1989

[30] Foreign Application Priority Data

Mar. 14, 1988 [CA] Canada ..... 561416

[51] Int. Cl.[4] ..... E01C 19/45; F24H 1/00

[52] U.S. Cl. ..... 126/343.5 A; 431/354

[58] Field of Search ..... 126/343.5 A, 343.5 R, 126/369, 369.1, 350 R, 271.1; 431/354, 328, 329

[56] References Cited

U.S. PATENT DOCUMENTS 1,709,016 4/1929 Hendricks ..... 126/343.5 A
1,855,961 4/1932 Hargrave ..... 126/343.5 A
3,837,789 9/1974 Schindler ..... 431/354

FOREIGN PATENT DOCUMENTS 793879 4/1958 United Kingdom ..... 126/343.5 A
989355 4/1965 United Kingdom ..... 126/343.5 A
1024859 4/1966 United Kingdom ..... 126/343.5 A

*Primary Examiner*—James C. Yeung
*Attorney, Agent, or Firm*—Pascal & Associates

[57] ABSTRACT

An underfired kettle for heating rubberized asphalt comprising a concave material container for containing rubberized asphalt, an outer container spaced from and closed to the outside convex wall of the material container, a sinuous tube contained between the material container and outer container passing adjacent the major surface area of the material container, one end of the tube being ported through the outer container, the tube containing spaced orifices in its sides along the length of its sides, and means for passing a burning gas into the port through the tube for heating air within the tube, whereby the air and exhaust of the burning gas can pass through the orifices and into the space between the material container and outer container, thereby heating a major portion of the material container and rubberized asphalt contained therein.

14 Claims, 1 Drawing Sheet

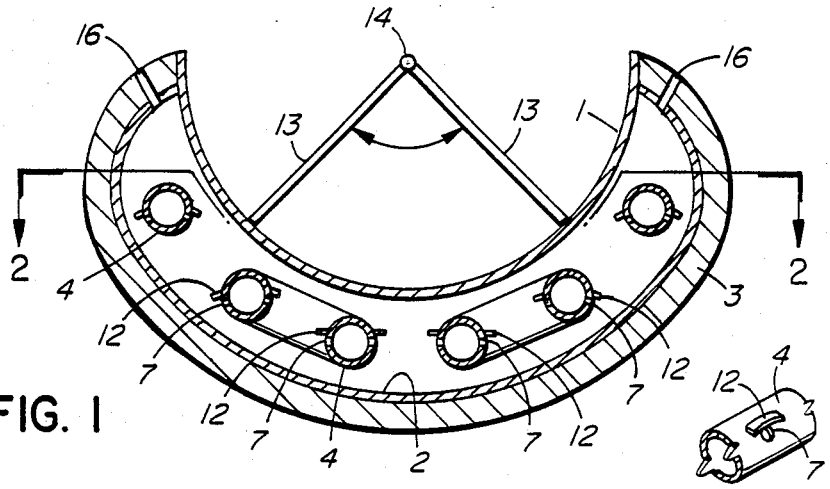
FIG. 1
FIG. 3
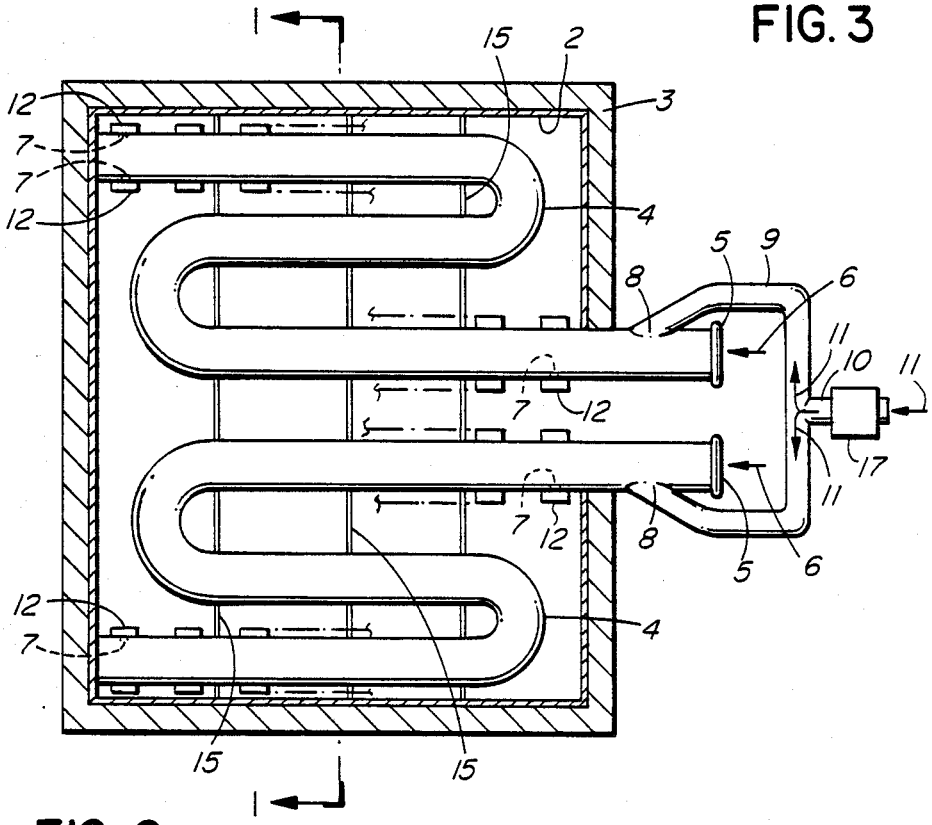
FIG. 2

UNDERFIRED KETTLE

This invention relates to an underfired kettle for heating rubberized asphalt used in roofing and/or sealing of cracks in roads, highways and airport runways.

In order to apply rubberized asphalt to roofing, roads, etc., it must be in a liquid or semi-viscous liquid state. To be placed into such a state, the asphalt is typically heated in a kettle, at about 400° - 475° F.

Heating of rubberized asphalt to melt it has been both expensive and sometimes dangerous. There are two basic types of rubberized asphalt heating kettles in use today, although other types are known. In the direct fired type, one or more propane torches are placed at the open end of heating tubes. Heat and flame are forced through the tubes and heat is transferred through the steel tube walls directly to the rubberized asphalt, melting the asphalt at 475° C. - 500° F. However the temperature of the tubes must be in excess of 500° F. in order that the asphalt can heat up to its usable temperature in a reasonable period of time, e.g. 4 -5 hours. Great caution must be exercised in heating rubberized asphalt quickly, since flash fires occur regularly. Asphalt chars when overheated, and tends to burst into flame rapidly at temperatures in excess of 500° F.

Oil bath kettles have been used primarily for warming up liquid asphalts or semi-solid materials that require lower melt temperatures. These kettles have two inner walls and an insulated outer wall, usually made of 14 to 16 gauge metal. Approximately 100 to 120 gallons of heat transfer oil are contained between the two inner walls. Also contained between the two inner walls and immersed in the transfer oil are heating tubes. Propane fired torches are placed at the open ends of the heating tubes. The heat passes into the tubes, through the tube walls into the heat transfer oils, and in turn through the inner wall into the liquid or semi-solid rubberized asphalt which is to be heated. The heat transfer oil has a published flash point of 500° F. Since the product that is to be heated requires temperatures of 400° F. - 475° F. before it is usable, it usually takes up to five hours to bring the rubberized asphalt to a workable temperature.

Another major problem occurring with this type of kettle is that if it is not used on a fairly regular basis, water condensation occurs between the two inner walls and sinks to the bottom of the oil chamber. When the oil is heated past the boiling point of water (212° F.) a miniature explosion takes place within the double walls and forces the heat transfer oil out through breathing ports. In a typical case, in excess of a barrel (45 gallons) of oil has been lost in less than 30 seconds.

In a third type of kettle, for example that described in U.K. Pat. 989,355, air is contained between the inner and outer walls. A tube passes axially below the kettle between the walls, and has side ports which exhaust into the space (cavity) between the walls. Combustion exhaust gases pass into the tube and out of the exhaust ports into the space between the walls, heating the rubberized asphalt container. In this structure, however, there is intense heat concentrated at the bottom of the kettle, requiring the use of very hot temperatures to heat the rubberized asphalt along the kettle walls remote from the bottom, with the dangers referred to above.

In the present invention, the last-noted structure is substantially improved. Firstly, the heating tube follows a meandering path over virtually the entire surface of the asphalt containing kettle in the space between the walls. Burning propane is introduced into one end of the tube, with air if required, add the resulting exhaust pass outwardly through spaced ports in the tube into the space between the inner and outer jackets. Because the exhaust gases would create hot spots, with resulting charring of the rubberized asphalt located in the kettle adjacent the ports in the tube, deflectors are used above each of the ports in the tube, thereby spreading the exhaust over a broad area of the kettle surface within the cavity. In addition, the ports are spaced at decreasing distances from each other starting from the point at which the propane is introduced. This creates a more even heat distribution within the rubberized asphalt than can be obtained by the use of the invention in the aforenoted British patent. A heavy wall thickness of the inner container is also preferred to be used, in order to disperse the heat as uniformly as possible.

To further assist the uniformity of heat transfer from the inner wall to the material, an agitation system for agitating the asphalt is preferred to be used. Thus higher heating temperatures can be used, shortening the initial heat up time as well as the overall recovery time considerably, while at the same time avoiding charring, explosions, and burning of the rubberized asphalt.

In general, the preferred embodiment of this invention is an underfired kettle for heating rubberized asphalt comprising a concave material container, an outer container spaced from and closed to the outside convex wall of the material container, and a sinuous tube contained between the material container and the outer container passing adjacent the major surface area of the material container. One end of the tube is ported through the outer container. The tube contains spaced orifices in its sides along its sides along its length. A burning gas is passed into the port through the tube, whereby the air and exhaust of the burning gas can pass through the orifices and into the space between the material container and outer container, thereby heating a major portion of the material container and rubberized asphalt contained therein.

According to a second embodiment the orifices are spaced progressively closer together with distance along the tube from the ported end.

According to a third embodiment air and exhaust deflectors are located above the orifices to deflect the heated air and exhaust from impinging against the material container directly from the orifices.

A better understanding of the invention will be obtained by reference to the detailed description below, with reference to the following drawings, in which:

FIG. 1 is an axial cut-away view of the underfired kettle according to the present invention, FIG. 2 is a plan view of the underfired kettle with the concave material container removed, in order to illustrate the heating tubes, and FIG. 3 is a perspective view detailing an exhaust gas port and deflector.

FIG. 1 a section through the kettle is shown which corresponds to section A—A in FIG. 2. A thick concave asphalt container 1 is attached to an outer container 2 spaced from and closed to the outside of the convex wall of the material container. Preferably surrounding the outer container is an insulation layer 3. Contained within the space between the material and outer containers is at least one, and preferably two sinuous tubes 4. The sinuous tubes are not in contact with, but pass adjacent the major surface area of the material container. As shown in FIG. 2 one end of each of the sinuous tubes is ported through the outer container and has inlets 5. The other end of each of the tubes 4 is closed. Arrow 6 illustrates the entry of a burning preferably gaseous fuel such as propane into the inlets 5 of sinuous tubes 4.

Each of the tubes contains spaced orifices shown schematically as orifices 7, in its sides. These orifices can be typically between ¾" to 1 " diameter. The sinuous tubes can be e.g. 4" or greater outside diameter.

Preferably the holes are spaced about 18" apart near the end of the tube adjacent the inlet, the spacing being reduced gradually to about 4" at the far end. The spacing can be reduced in increments.

In order to increase the heating efficiency, and to force the exhaust gases through the spaced orifices 7 into the space between the material and outer containers, ports 8 in the tubes adjacent the inlet port 5 are connected via flexible air pipes 9 to an inlet 10, into which air, depicted by arrow 11 is introduced by means of a fan 17.

With burning propane entering inlet 5 and combustion air to carry the heat entering air inlet 10, the resulting hot exhaust passes through sinuous tubes 4, spaced orifices 7, and into the space between the material and outer containers 1 and 2. There is no heat dispersal medium other than exhaust laden air between the containers. Thus there is no oil or water condensate therein to explode.

Because the sinuous tubes pass adjacent the major convex wall surface area of the material container, dispersing the exhaust evenly around the wall surface the entire material container is heated evenly, thus heating rubberized asphalt which may be contained therein much more evenly than that described in British Pat. 989,355.

In addition, since there is no flammable medium between the inner and outer walls, the prospect of explosion is substantially eliminated. Because the exhaust is distributed by the sinuous pipes, the heat is not concentrated along a single or double axial line along the bottom of the material container, and overheating of the rubberized asphalt is avoided.

In order to further deflect the exhaust from impinging directly on the convex side of the material container, and ensure the avoidance of hot spots, deflector plates 12 are fastened e.g. by welding to the outside of the sinuous tubes 4 immediately above each of the spaced orifices 7. The deflector plates are preferably 2½" long by 1" wide, located above each hole with the hole centrally located from each end of the corresponding deflector plate. Preferably the deflector plate is formed of ⅜" steel.

With the above structure the burning propane and air exhaust pass into the space between the material and outer containers, with the cooler gases toward the end of the tubes being emitted at more frequent intervals than at the hotter, inlet end in order to evenly distribute the heat energy into the space between the material and outer containers. The deflector plates ensure that the hot gases are dispersed and do not impinge directly on the convex side of the material container. The heat is thus transferred evenly to the rubberized asphalt, avoiding hot spots and overheating. Further, because an oil transfer medium is not used, the possibility of the explosion of condensate is avoided. Yet because the extremely hot exhaust gases are used to transfer heat energy into an air and exhaust transfer medium within the cavity between the material container and outer container, the heat energy is both intense and evenly distributed, avoiding overheating and at the same time resulting in very rapid initial melting or heat recovery of the rubberized asphalt.

In order to distribute the heat energy evenly throughout the rubberized asphalt, it is preferred that an rubberized asphalt agitator 13 should be used. This can be comprised of arms or paddles 13 reciprocating or rotating on a central axis 14, driven via a gear reduction mechanism from typically an internal combustion or electric motor or other motive power source.

The sinuous tubes can be supported by means of bulkhead plates 15 which extend within the space between the concave and outer containers, which can extend below the outer container to a supporting frame for the kettle (not shown). The bulkhead plates 15 can also be used to section off regions of the space between the material and outer containers to retain the heat energy between the bulkhead plates which is imparted thereto by the gases.

The heat energy is retained within the space between the concave and outer containers by means of the insulation 3, which can be for example fiberglass, which retards loss of heat outwardly from the outer container. Exhaust tubes 16 exhaust the gases to the ambient from the space between the concave and outer containers, since the ends of the sinuous tubes 4 remote from the inlet ports 5 are sealed.

A person understanding this invention may now conceive of alternative structures and variations using the principles described herein. All are considered to be within the sphere and scope of this invention as defined in the claims appended hereto.

I claim:

1. An underfired kettle for heating rubberized asphalt comprising a concave material container for containing rubberized asphalt, an outer container spaced from and closed to an outside convex wall of the material container, a sinuous tube contained between the material container and outer container passing adjacent a major surface area of the material container, one end of the tube passing through the outer container, the tube containing spaced orifices in its sides along the length of its sides, and means for passing a burning gas into said one end of the tube for heating air within the tube, whereby said air and exhaust of the burning gas can pass through said orifices and into the space between the material container and outer container, thereby heating a major portion of the material container and rubberized asphalt container therein.

2. A kettle as defined in claim 1 in which the orifices are spaced progressively closer together with distance along the tube from the ported end.

3. A kettle as defined in claim 2 further including air and exhaust deflectors located about the orifices to deflect the heated air and exhaust from impinging directly against the material container from the orifices.

4. A kettle as defined in claim 2 further including air and exhaust deflectors welded to the tube above the orifices to deflect the heated air and exhaust from impinging directly against the material container from the orifices.

5. A kettle as defined in claim 2 further including air and exhaust deflectors welded to the tube above the orifices to deflect the heated air and exhaust from impinging directly against the material container from the orifices, the outer surface of the outer container being insulated.

6. A kettle as defined in claim 2 further including air and exhaust deflectors welded to the tube above the orifices to deflect the heated air and exhaust from impinging directly against the material container from the orifices, the outer surface of the outer container being insulated, and paddles contained within the material container for agitating the rubberized asphalt contained with the material container.

7. A kettle as defined in claim 2 including a fan for blowing said air into the tube under pressure.

8. A kettle as defined in claim 2 further including air and exhaust deflectors welded to the tube above the orifices to deflect the heated air and exhaust from impinging directly against the material container from the orifices, and including a fan for blowing said air into the tube under pressure.

9. An underfired kettle for heating rubberized asphalt comprising a concave material container for containing rubberized asphalt, an outer container spaced from and closed to an outside convex wall of the material container, a sinuous tube contained between the material container and outer container passing adjacent a major surface area of the material container, one end of the tube passing through the outer container, the tube containing spaced orifices in its sides along the length of its sides, and means for passing a burning gas into said one end of the tube for heating air within the tube, whereby said air and exhaust of the burning gas can pass through said orifices and into the space between the material container and outer container, thereby heating a major portion of the material container and rubberized asphalt container therein, and further including air and exhaust deflectors located above the orifices to deflect the heated air and exhaust from impinging directly against the material container from the orifices.

10. A kettle as defined in claim 9 including a fan for blowing said air into the tube under pressure.

11. An underfired kettle for heating rubberized asphalt comprising a concave material container for containing rubberized asphalt, an outer container spaced from and closed to an outside convex wall of the material container, a sinuous tube contained between the material container and outer container passing adjacent a major surface area of the material container, one end of the tube passing through the outer container, the tube containing spaced orifices in its sides along the length of its sides, and means for passing a burning gas into said one end of the tube for heating air within the tube, whereby said air and exhaust of the burning gas can pass through said orifices and into the space between the material container and outer container, thereby heating a major portion of the material container and rubberized asphalt container therein, and further including air and exhaust deflectors welded to the tube above the orifices to deflect the heated air and exhaust from impinging directly against the material container from the orifices.

12. A kettle as defined in claim 11 further including the outer surface of the outer container being insulated.

13. A kettle as defined in claim 11 further including the outer surface of the outer container being insulated, and paddles contained within the material container for agitating the rubberized asphalt contained with the material container.

14. A kettle as defined in claim 11 further including a fan for blowing said air into the tube under pressure.

* * * * *